US008616368B2

(12) United States Patent
Guarisco, Jr.

(10) Patent No.: US 8,616,368 B2
(45) Date of Patent: Dec. 31, 2013

(54) SUB BASKET AND METHOD FOR STORING AND TRANSPORTING SUBS

(75) Inventor: Leonard J. Guarisco, Jr., Morgan City, LA (US)

(73) Assignee: Paragon Industries, Inc., Morgan City, LA (US)

( * ) Notice: Subject to any disclaimer, the term of this patent is extended or adjusted under 35 U.S.C. 154(b) by 107 days.

(21) Appl. No.: 13/423,890

(22) Filed: Mar. 19, 2012

(65) Prior Publication Data

US 2013/0240397 A1 Sep. 19, 2013

(51) Int. Cl.
*B65D 85/02* (2006.01)
*B65D 85/20* (2006.01)

(52) U.S. Cl.
USPC ..... 206/303; 206/443; 211/70.4

(58) Field of Classification Search
USPC ..... 206/303, 443; 211/70.4; 220/1.5; 410/34–36
See application file for complete search history.

(56) References Cited

U.S. PATENT DOCUMENTS

| | | | | |
|---|---|---|---|---|
| 6,450,330 | B1 * | 9/2002 | Cannata | 206/303 |
| 7,131,803 | B2 | 11/2006 | Guarisco, Sr. et al. | |
| 8,100,257 | B1 * | 1/2012 | Zimmer | 206/303 |
| 8,157,090 | B2 * | 4/2012 | Ingvardsen et al. | 206/315.9 |
| 8,230,991 | B1 * | 7/2012 | Zimmer | 206/303 |
| 2005/0074307 | A1 * | 4/2005 | Guarisco et al. | 410/36 |
| 2006/0169617 | A1 * | 8/2006 | Knight et al. | 206/443 |

* cited by examiner

*Primary Examiner* — J. Gregory Pickett
*Assistant Examiner* — Ned A Walker
(74) *Attorney, Agent, or Firm* — Jason P. Mueller; Adams and Reese, LLP

(57) ABSTRACT

A sub basket configured to receive tangs upon which the subs are installed. The sub basket having support members that engaged the tangs and secure them to the sub basket. The support members securable via at least one of a handle latch, a door and a pin latch locking the door closed.

15 Claims, 22 Drawing Sheets

SUB BASKET AND METHOD FOR STORING AND TRANSPORTING SUBS

FIELD

The present disclosure relates to storage and transportation of subs used in oil field and gas well applications. More particularly, the present disclosure relates to a new basket apparatus for storage and transportation of subs and methods of utilizing the basket apparatus.

BACKGROUND

Drilling a well, such as an oil or gas well, is accomplished with a drill, or string, which is made up of multiple members engaged end to end to create the string. Some individual members or segments are referred to as "subs" and are relatively short joints of pipe (typically 7' or less). Subs may be added to the string to lengthen the string. Each sub typically has internal and external threads, allowing for the succession attachment of subs to lengthen the string. Subs may vary in lengths, sizes and threading. Despite being relatively short, the subs are typically made from iron or steel and are heavy.

Because they are tubular, the subs, if not fastened down or otherwise stored, can have a tendency to roll or move around the floor or basket if the subs are maintained in a basket. Typically sub baskets are not designed for vertically installing the subs; the subs are usually stacked on their sides in a sub basket. Since the subs vary in lengths, sizes, and threading, the desired sub may be located on the bottom of a stack of subs, requiring removal of all of the subs on top of the desired sub in order to obtain it. If subs are maintained vertically in a sub basket, the subs may not be secured in the basket or, if secured, may still move around in the basket.

Transporting subs in a basket can cause the subs to move or shift. Due to their weight, storage and transportation of subs creates a potential injury risk to oil and gas workers using subs in the field. There is also concern that the subs themselves can be harmed if they are not prohibited from rolling or shifting during transportation or storage. Accordingly, for safety of workers and preservation of the subs, the subs should be secured. Securing a sub is usually done by laboriously latching each individual sub in a basket.

Therefore, there is a need for a more efficient and more secure apparatus and method to store and transport subs.

SUMMARY

An apparatus for storing and transporting subs is provided including: a frame having a bottom portion and a front side, a back side, a first end and a second end, the sides and ends being fixed to the bottom portion, an interior portion formed by the bottom portion and the fixed sides and ends and an open top section; a plurality of tangs having a base portion, an elongated pin extending upwards from the base portion, and a cap; a plurality of support members fixed orthogonally to a top portion of the first and second ends such that the support members may be rotated into open and closed positions; handle latches fixed to the top portions of the first and second ends such that each latch may engage and lock the support members in an open or closed position; a first door hinged to the first end such that the door may be closed to lock the support members in position or opened to permit repositioning of the support members; a second door hinged to the second end such that the door may be closed to lock the support members in position or opened to permit repositioning of the support members; and a first and second pin latch fixed to the first and second doors such that the doors may be locked in closed positions. The tang may receive a sub, the sub having a top portion, a bottom portion and a central bore extending from the bottom portion to the top portion. The sub may be installed on the tang by passing the elongated pin of the tang through the central bore of the sub, allowing the bottom portion of the sub to rest upon a receiving surface on the base portion of the tang and placing the cap upon the top portion of the sub. The elongated pin of the tang may be longer than the sub allowing the elongated pin of the tang to extend beyond the cap. The tangs may be arranged vertically on the bottom portion of the frame such that the support member may engage top portions of the tangs when the support member is in a closed position.

DETAILED DESCRIPTION

Figure 1:
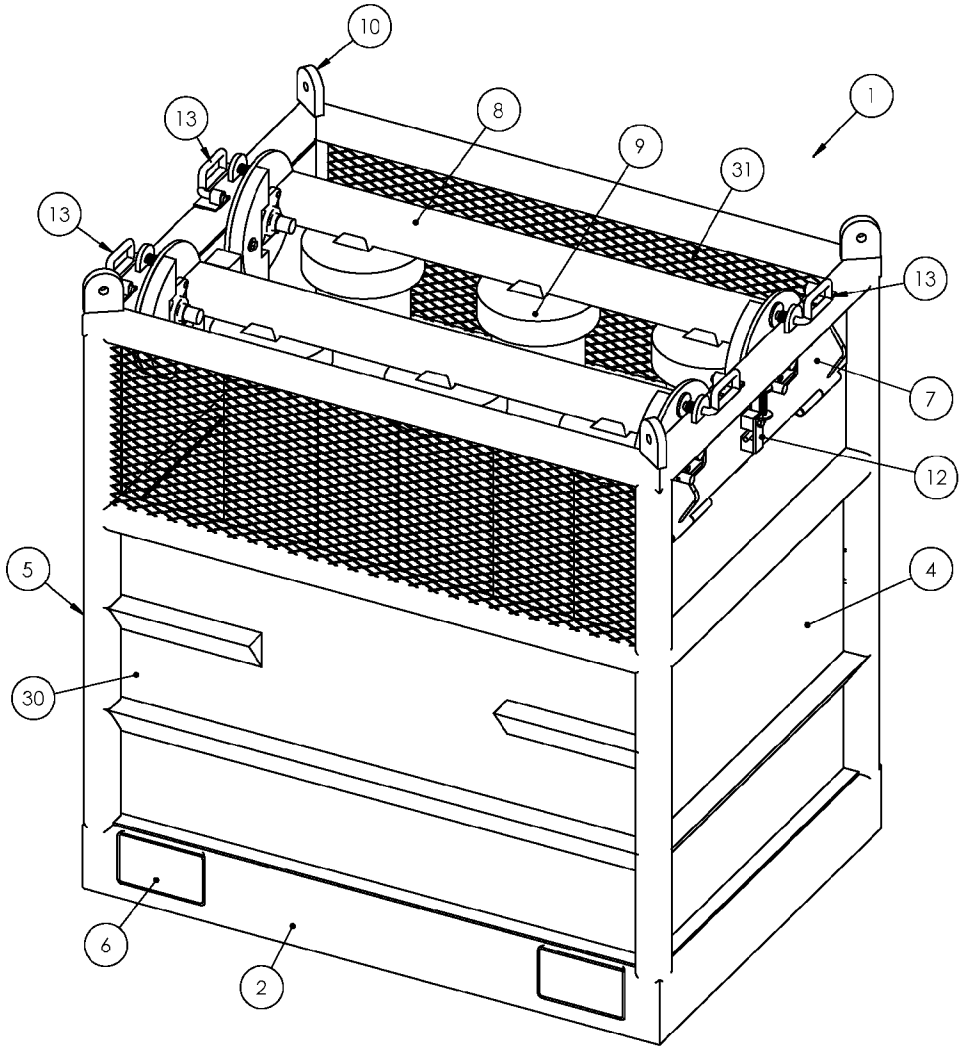
FIG. 1 is an isometric view of a sub basket, according to an exemplary embodiment of the present invention.

Like reference characters denote like parts in several drawings.

FIG. 1 shows an apparatus 1 for storing and transporting tubular subs said apparatus having a frame, including a bottom portion 2 and a front side 30, a back side 3, and first 4 and second 5 ends, the sides 30 and 3 and ends 4 and 5 being fixed to the bottom portion 2, an interior portion formed by the bottom portion 2 and the fixed sides 30 and 3 and ends 4 and 5 and an open top section 31. Support members 8 are fixed generally orthogonally to a top portion of the first and second ends 4 and 5 such that the support members may be rotated or positioned into open and closed positions. A door 7 hinged to the first end 4 is shown such that the door may be closed to lock the support member 8 in position or opened to permit rotation or positioning of the support member 8.

Figure 2:
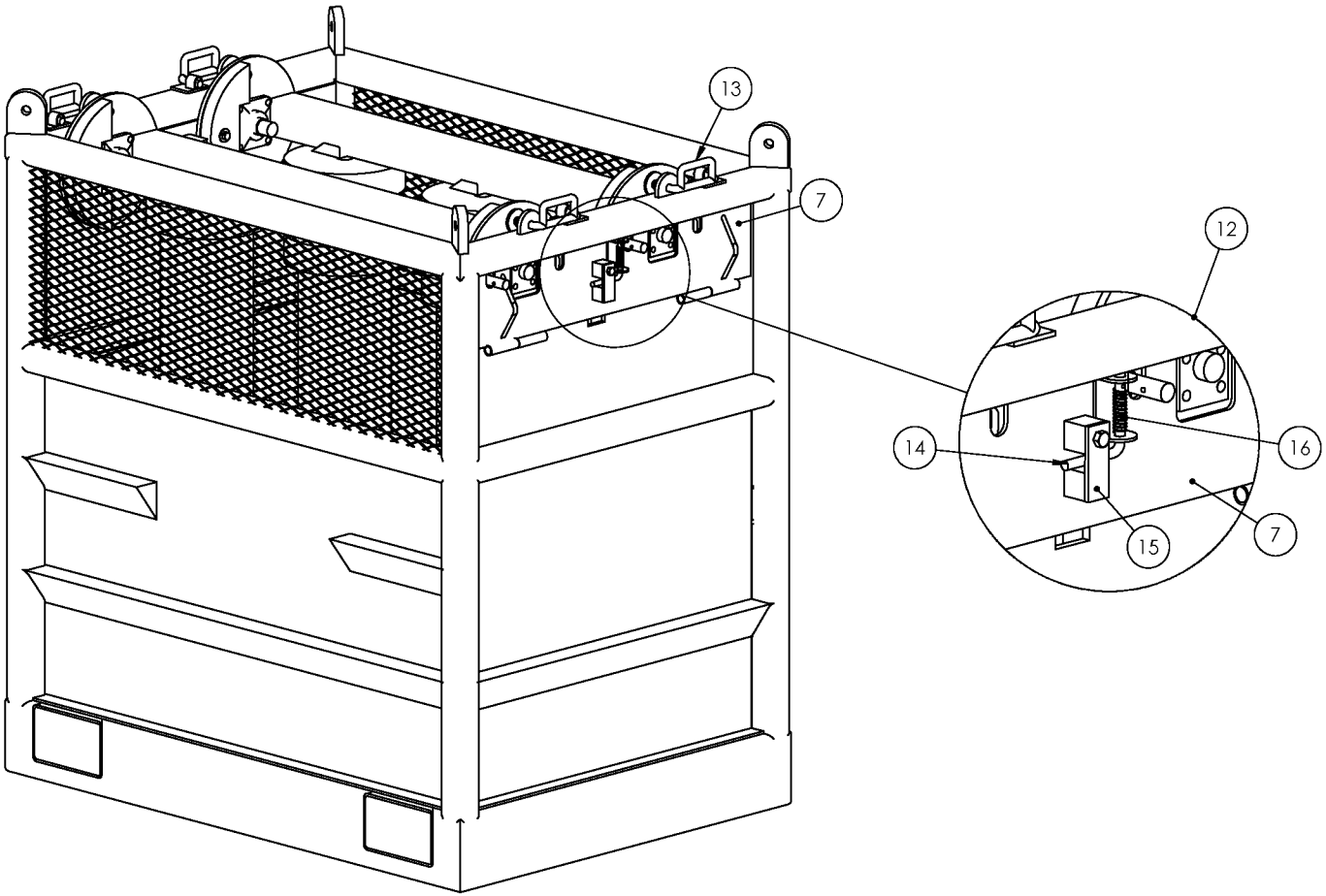
FIG. 2 is an isometric view of a sub basket with an enlarged view of a pin latch fixed to a door where the door is closed, according to an exemplary embodiment of the present invention.

FIG. 2 shows a enlarged view of the door 7 fixed to the first end 4 in a closed position and a pin latch 12 fixed to the door 7 such that the door is locked in a closed position. The pin latch 12 includes a pin 14 of the pin latch 12 which may engage the first end 4 such that the door 7 is locked closed. The pin latch 12 also includes a first compression spring 16, holding the pin 14 of the pin latch 12 partially extended into a pinlatch aperture on the first end 4. To release the pin latch 12, a second latch 15 may be rotated to permit an engaged portion of the pin 14 of the pin latch 12 to pass out of the second latch 15. After the pin 14 of the pin latch 12 is free of the second latch, a load may be applied against the compression spring 16 to disengage the pin 14 from the latch aperture on the first end 4. A similar arrangement may be found on the second end 5 having a second door with a fixed second pin latch.

Figure 3:
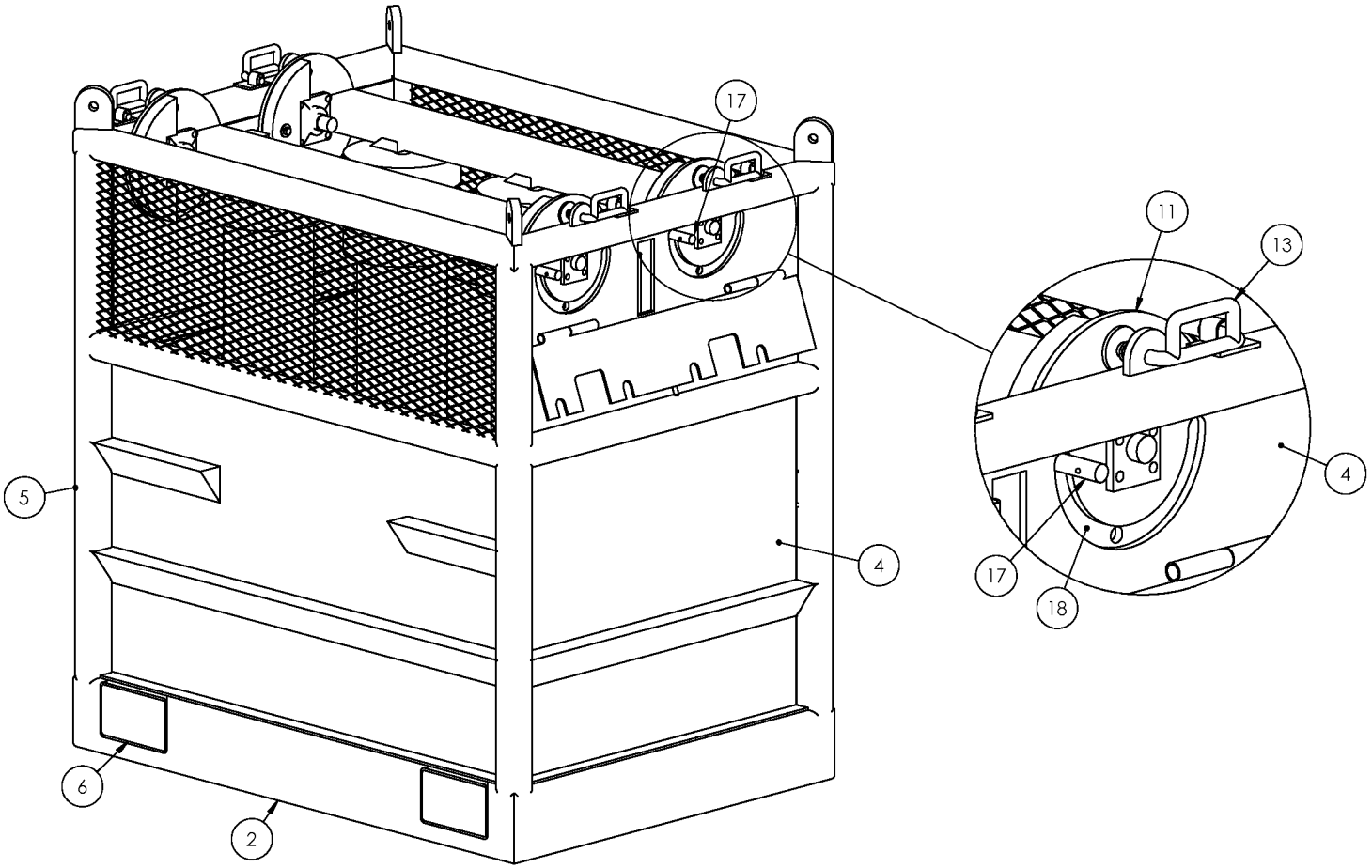
FIG. 3 is an isometric view of a sub basket showing a door in an open position and an enlarged view of a supporting member with an end disc and a disc pin attached to the end disc passing through an end of a frame of the sub basket where the supporting member is in a closed position, according to an exemplary embodiment of the present invention.
Figure 4:
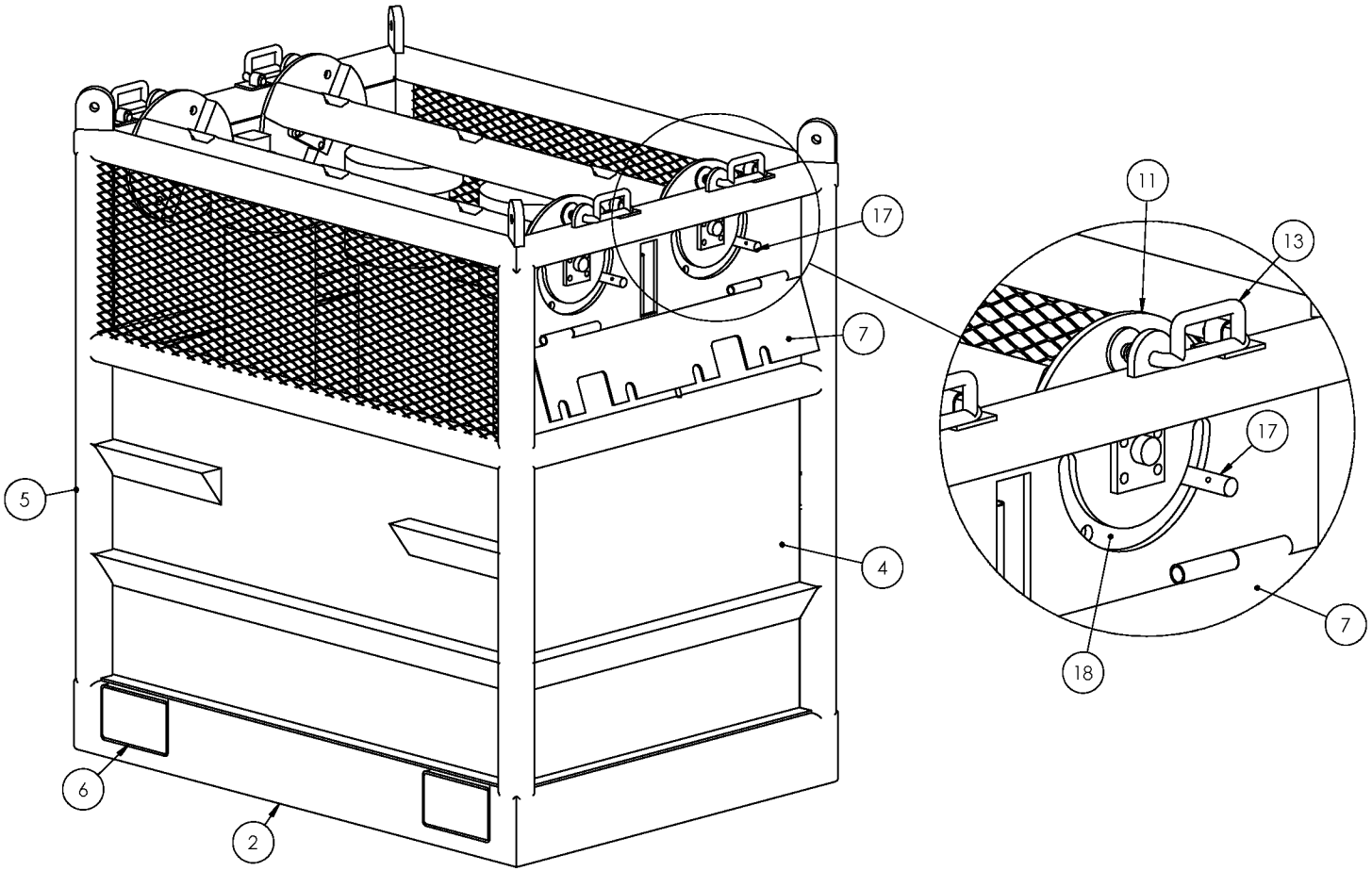
FIG. 4 is an isometric view of a sub basket showing a door in an open position and an enlarged view of a supporting member with an end disc and a disc pin attached to the end disc passing through an end of a frame of the sub basket where the supporting member is in an open position, according to an exemplary embodiment of the present invention.

FIGS. 3 and 4 show the sub basket apparatus 1 having the first door 7 in an open position. The open door 7 uncovers a portion of a circular disc end 11 of the support member 8 and a disc pin 17 attached to a side of the circular disc end 11 opposite of an elongated support portion 26. The disc pin 17 extends from the circular disc end 11 through an arched opening 18 in the first end 4. The disc pin 17 may be used to reposition the support member 8. When the disc pin 17 is moved to a position of the arched opening 18 closest to the front side 30 of the sub basket frame, the support member 8 is in a closed position as shown in FIG. 3. When the disc pin 17 is moved to a position of the arched opening 18 closest to the back side 3 of the sub basket frame, the support member 8 is in an open position as shown in FIG. 4. Disc pin 17 may be configured to engaged an extension member that an operator may use to safely and efficiently position support members 8.

Also shown in FIGS. 3 and 4 are handle latches 13 fixed to a top portion of the first end 4 and the second end 5. The handle latches 13 are placed such that a protruding portion 33 of the handle latch 13 may engage the circular disc ends 11 at a plurality of handle latch apertures 32 thereon. When the handle latch 13 is engaged with the circular end 11 at one of the handle latch apertures 32, the supporting member 8 will be held into a position corresponding to the handle latch aperture 32 engaged.

Figure 5:
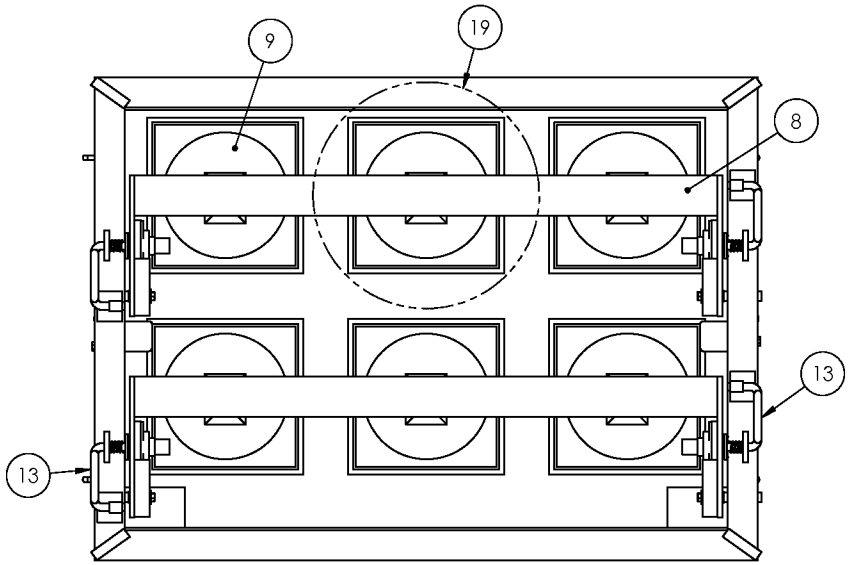
FIG. 5 is a top view of a sub basket, according to an exemplary embodiment of the present invention.
Figure 5A:
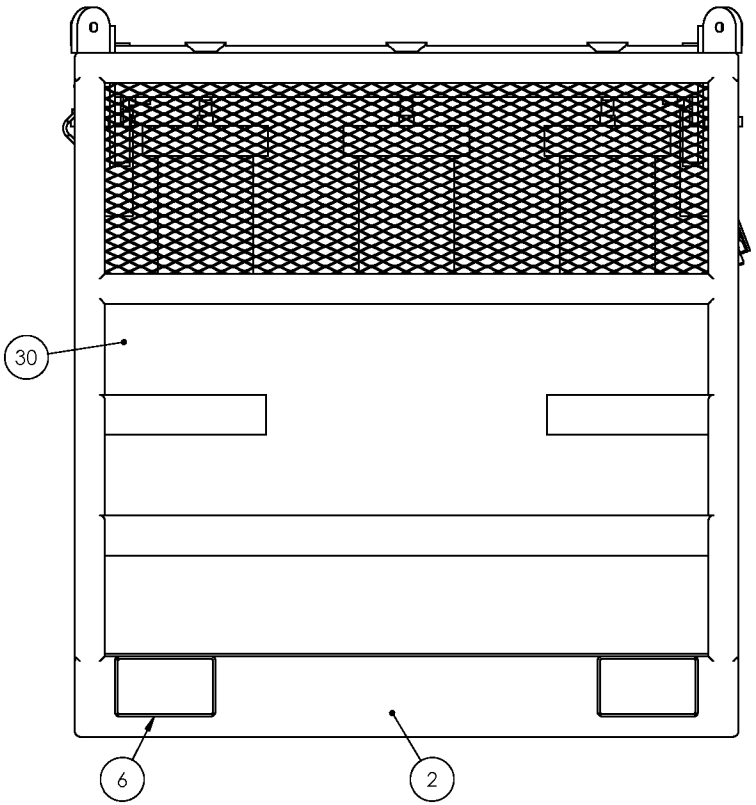
FIG. 5A is a front view of a sub basket, according to an exemplary embodiment of the present invention.
Figure 5B:
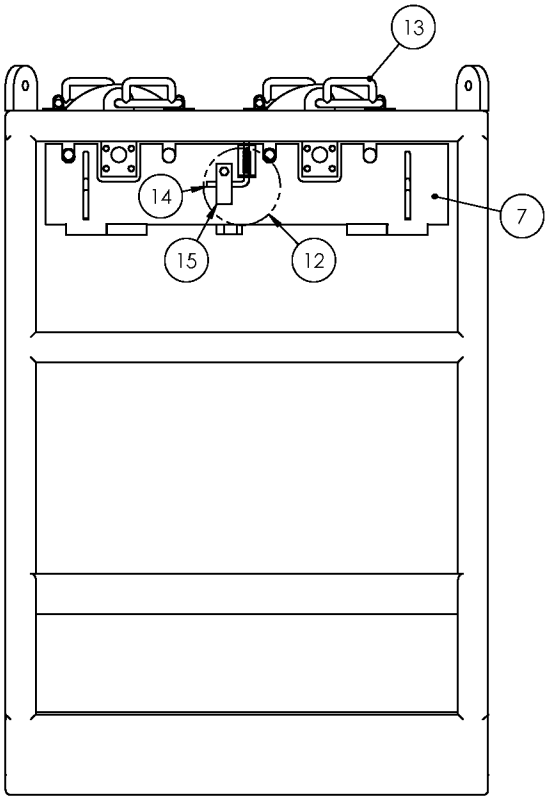
FIG. 5B is an end view of a sub basket, according to an exemplary embodiment of the present invention.

FIGS. 5, 5A, and 5B illustrate the sub basket 1 with six tangs 19 loaded into the sub basket 1 and the supporting member 8 in a closed position. A plurality of tang receiving apertures 20 are located along an underside of the elongated support portion 26 of the support member 8 to receive a top portion of a tang 19 when the support member 8 is in a closed position.

Figure 6:
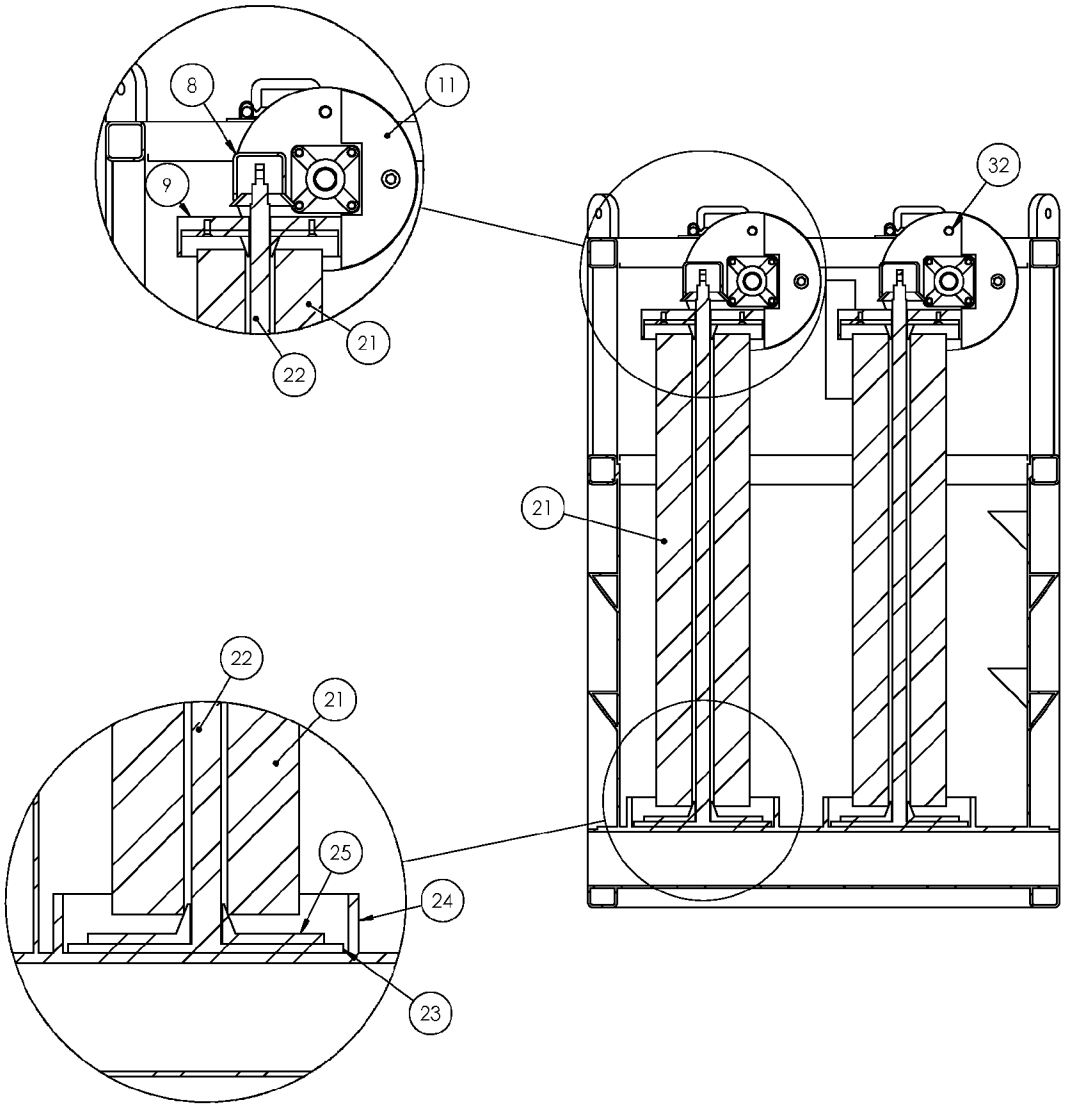
FIG. 6 is an end cross-section of a sub basket with enlarged views of a top of a tang engaged by a supporting member and a base of the tang in a tang receiving fixture on the floor of the sub basket, according to an exemplary embodiment of the present invention.
Figure 7:
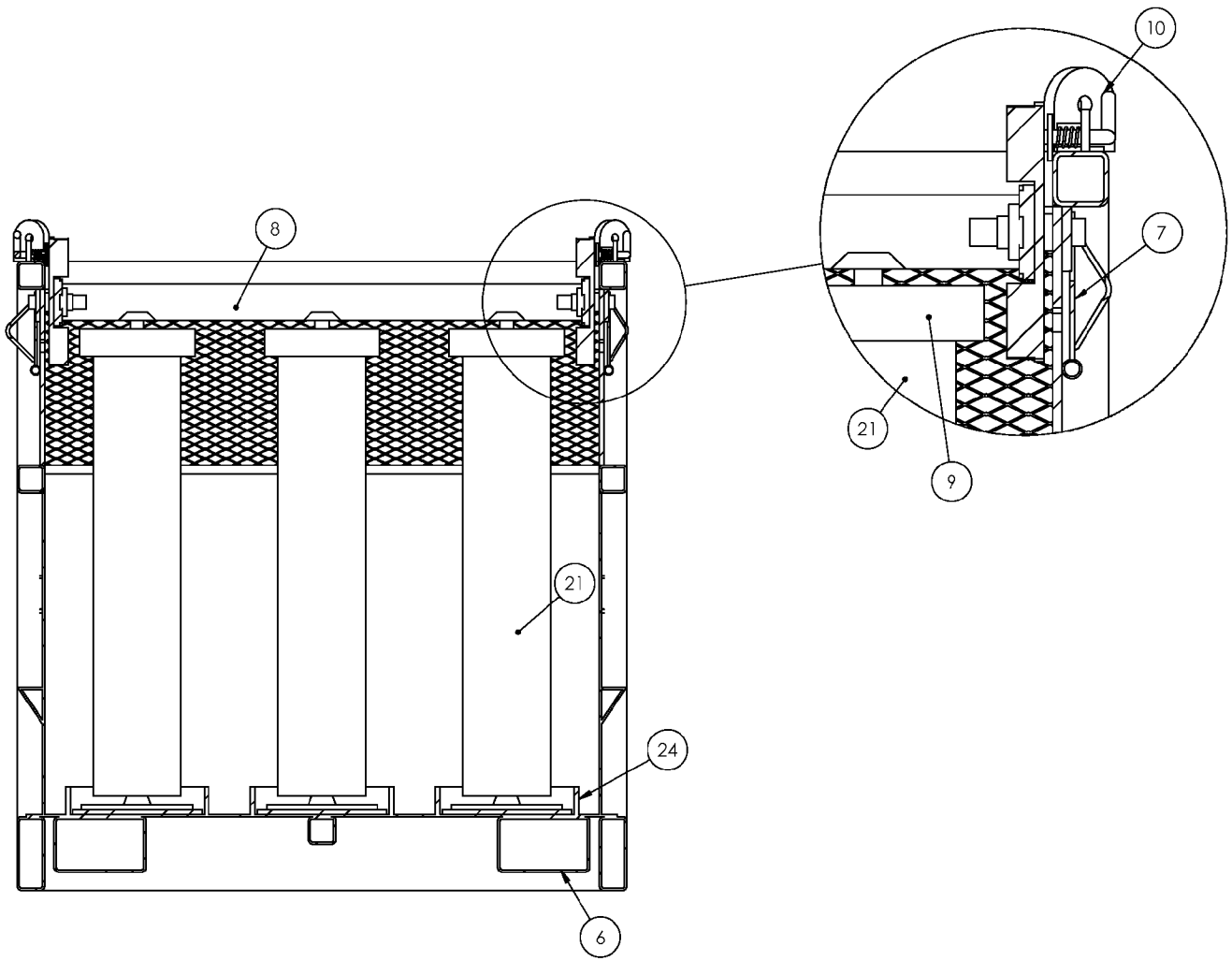
FIG. 7 is a front cross section of the sub basket apparatus with an enlarged view of a top portion of an end of the sub basket, according to an exemplary embodiment of the present invention.

FIGS. 6 and 7 show the sub basket 1 having a sub 21 installed upon an elongated pin 22 of the tang 19, which passes through a central bore of the sub 21, allowing a bottom portion of the sub 21 to rest upon a receiving surface 25 on a base portion 23 of the tang 19. The receiving surface 25 may be a replaceable rubber surface. The base portion 23 of the tang 19 is placed into a tang receiving fixture 24 on the bottom portion 2 of the sub basket 1. The elongated pin 22 of the tang 19 extends beyond the sub 11, and a cap 9 having a central bore 28 is placed on the top portion of the sub 21. The elongated pin 22 may be threaded and the central bore 28 of the cap 9 may be threaded such that the cap may be threaded onto the elongated pin 22. A top portion of the elongated pin 22 of the tang extends beyond the cap 9 and is engaged by the tang apertures 20 on the elongated portion of the support member 8 when the support member 8 is in a closed position. In the bottom portion 2 of the sub basket 1, fork lift apertures 6 are included such that the sub basket 1 may be moved via fork lift.

Figure 8:
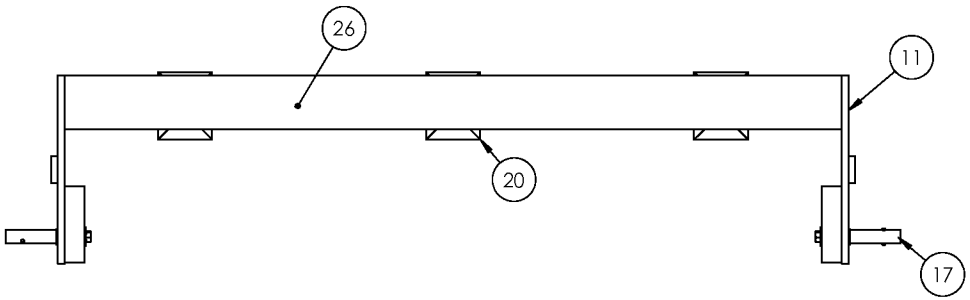
FIG. 8 is a top view of a support member, according to an exemplary embodiment of the present invention.
Figure 8A:
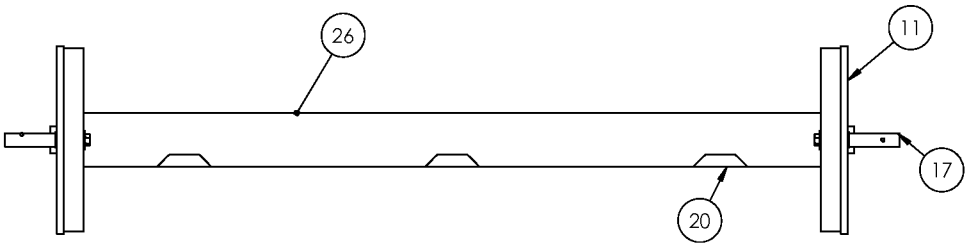
FIG. 8A is side view of a support member, according to an exemplary embodiment of the present invention.
Figure 9:
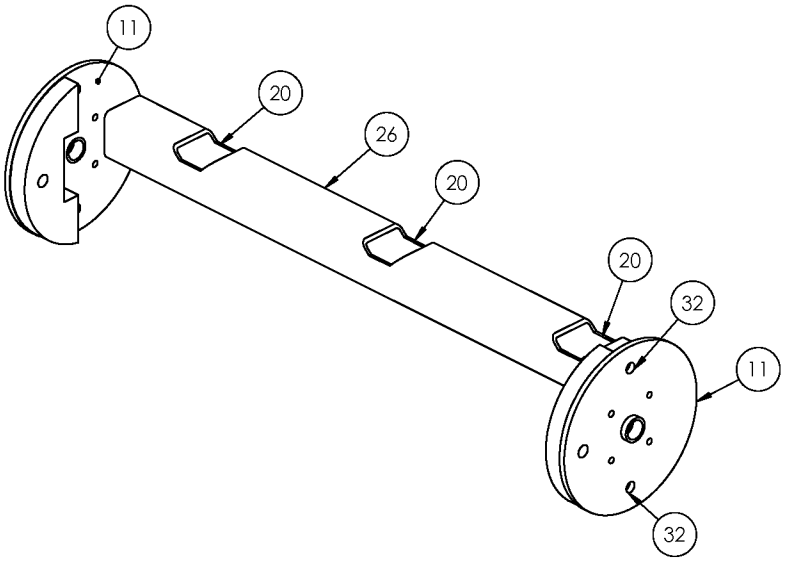
FIG. 9 is an isometric view of a support member shown in FIGS. 8 and 8A, according to an exemplary embodiment of the present invention.

FIGS. 8, 8A, and 9 show view of the support member 8 having the elongated portion 26 and the circular disc ends 11. Extending from the circular disc ends 11 are the disc pins 17. The tang receiving apertures 20 are located on an underside of the elongated portion 26 of the support member 8.

Figure 10:
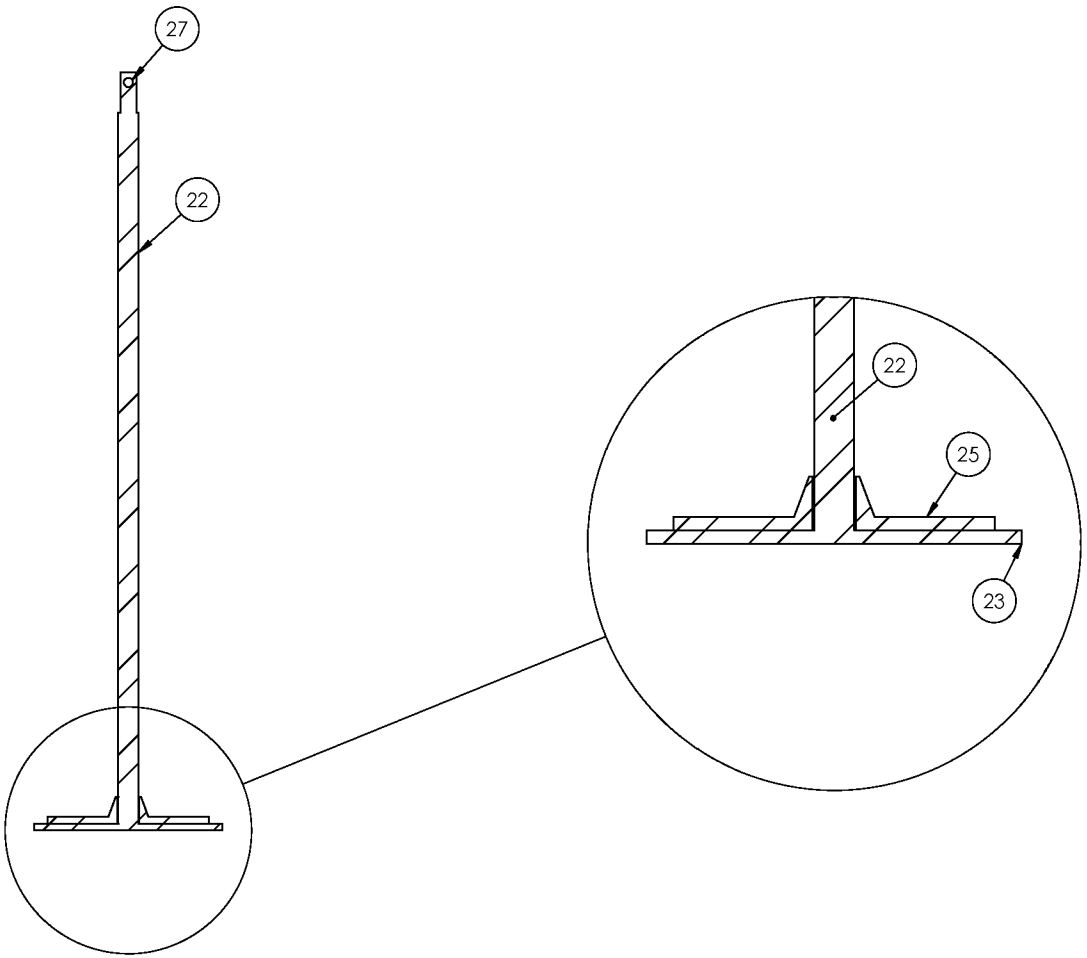
FIG. 10 is a cross-section of a tang without an installed sub, according to an exemplary embodiment of the present invention.
Figure 10A:
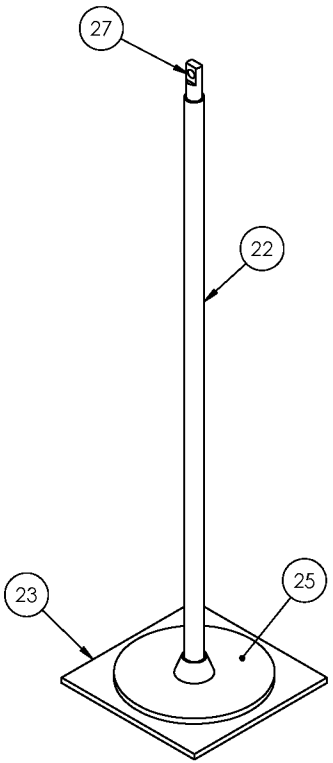
FIG. 10A is an isometric view of a tang without an installed sub, according to an exemplary embodiment of the present invention.
Figure 18:
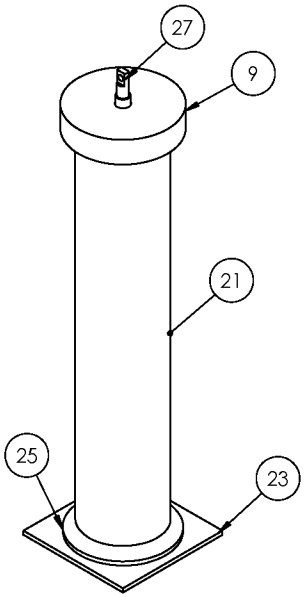
FIG. 18 is an isometric view of a tang with a sub installed on the tang, according to an exemplary embodiment of the present invention.

FIGS. 10 and 10A illustrate a tang 19 without a sub installation including the base portion 23, the receiving surface 25, the elongated pin 22 and an eyelet 27 on the top of the elongated pin 22. FIG. 18 illustrates the same features of the tang 19 where the sub 21 has been installed upon the tang 19 resting upon the receiving surface 25 and held in place by the cap 9 which has been threaded on the elongated pin 22 such that the sub 21 is held securely in place on the tang 19.

Figure 11:
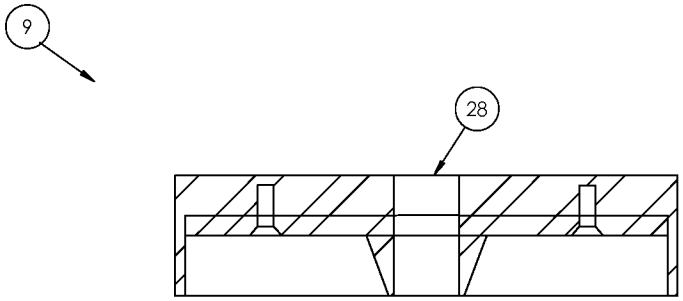
FIG. 11 is a side cross-section of a cap, according to an exemplary embodiment of the present invention.
Figure 12:
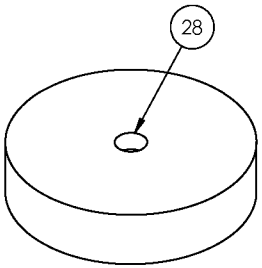
FIG. 12 is an isometric view of a cap, according to an exemplary embodiment of the present invention.
Figure 13:
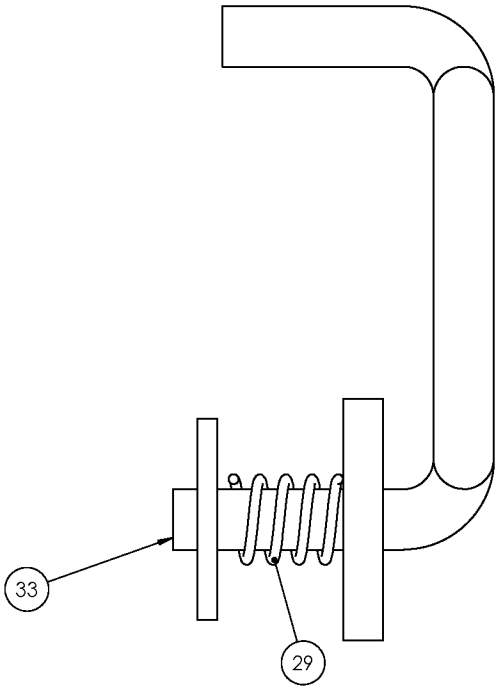
FIG. 13 is a top view of a handle latch, according to an exemplary embodiment of the present invention.
Figure 14:
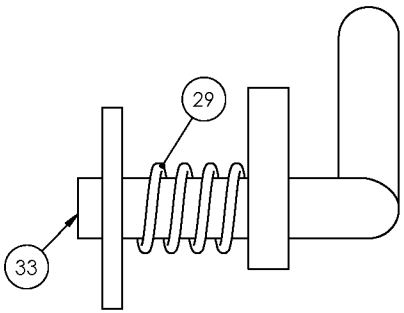
FIG. 14 is a side view of a handle latch, according to an exemplary embodiment of the present invention.
Figure 15:
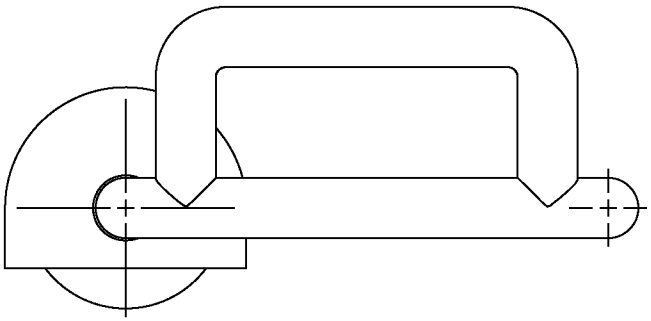
FIG. 15 is an end view of a handle latch, according to an exemplary embodiment of the present invention.
Figure 16:
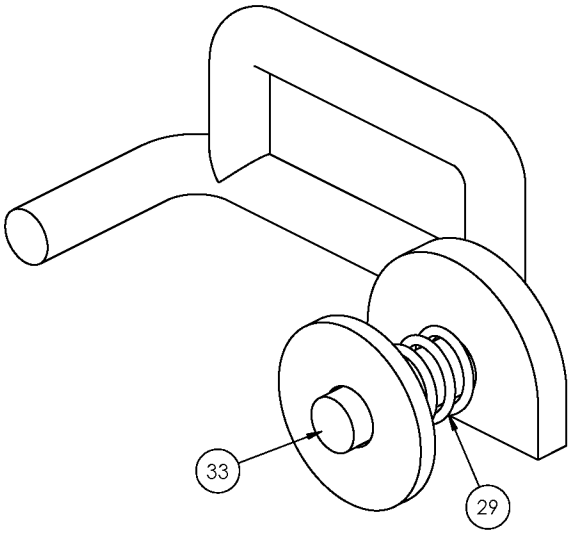
FIG. 16 is an isometric view of a handle latch shown in FIGS. 13, 14, and 15, according to an exemplary embodiment of the present invention.
Figure 17:
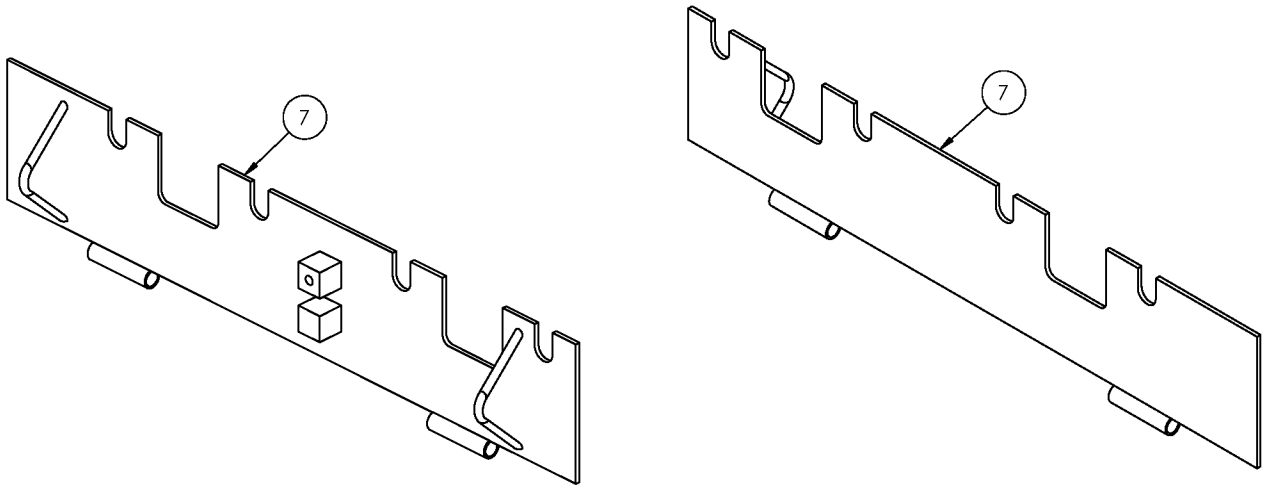
FIG. 17 is an isometric view of doors, according to an exemplary embodiment of the present invention.

FIGS. 11 and 12 show views of the cap 9 including the central bore 28 through which the elongated pin 22 may pass or be threaded.

FIGS. 13, 14, 15, and 16 illustrate the handle latch 13 having a second compression spring 29 holding the handle latch in position 13 such that the protruding portion 33 of the handle latch 13 may engage the circular disc end 11 at one of the handle latch apertures 32 located on the circular disc end 11.

While the drawings reflect a sub basket having up to six tangs placed therein for storage and transport and having two support members to secure the tangs in the sub basket, different configurations involving more tangs, less tangs, more support members or less support members may be pursued for the present disclosure.

In an exemplary embodiment of the present disclosure, the sub 21 may be installed upon the tang 19 by passing the elongated pin 22 of the tang 19 through the central bore of the sub 21 until the bottom portion of the sub 21 rests upon the receiving surface 25 on the top of the base portion 23 of the tang 19. The sub 21 may then be secured on the tang 19 by threading the cap 9 on the elongated pin 22 until the cap 9 is secure on the top portion of the sub 21. Once the sub 21 is securely installed on the tang 19, the tang 19 may be lifted via the eyelet 27 and moved into the sub basket 1 wherein the support member 8 is in an open position. The tang 19 is lowered into the interior portion of the sub basket 1 until the base portion 23 of the tang 19 is placed within one of the tang receiving fixtures 24 on the bottom portion 2 of the sub basket 1. After the tang 19 is placed into the tang receiving fixture 24, a load is applied to the handle latches 13 of the support member 8 until the handle latches 13 disengage from the handle latch apertures 32 on the circular disc ends 11 of the supporting member 8, allowing the support member 8 to be rotated. The disc pin 17 is then moved to a position on the arched opening closest to the front side 30 of the sub basket 1 such that the tang aperture 20 on the support member 8 passes over the top portion of the tang 19 and the handle latches 13 engage the handle latch apertures 32 on the circular disc ends 11 where the supporting member 8 is in a closed position. The tang 19 is thus securely held in place inside the sub basket 1. The door 7 may then be closed applying a load to the pin 14 of the pin latch 12 and closing the door 7 until the pin 12 is able to engage the pin latch aperture. Once the pin 14 of the pin latch 12 has engaged the pin latch aperture, the pin 14 of the pin latch 12 may be rotated such that a portion of the pin 14 engages the second pin latch 15 and the second pin latch 15 may be closed with a portion of the pin 14 held therein.

An exemplary embodiment of the present disclosure provides an efficient and secure apparatus for the storage and transportation of subs. By first installing a sub on a tang and then securing multiple tangs in a sub basket simultaneously by closing a support member, subs within the sub basket are substantially prevented from moving without the need for separate latch attachments to each sub in the sub basket. Moreover, access to the subs for removal is efficiently accomplished by repositioning the support member and removing the tang having the desired sub installed thereon.

In another exemplary embodiment, a sub basket 1 assembly is provided having a bottom portion 2 with tang receiving fixtures 24 spaced thereon, a plurality of frame sides 30 and 3 and frame ends 4 and 5 fixed to the bottom portion 2 forming the basket, a plurality of support members 8 fixed to a top portion of the frame ends 4 and 5 such that the support members 8 may be rotated into open and closed positions, and a plurality of tangs 19 having a base portion 23, an elongated pin portion 22 and a cap 9. The tang 19 may receive a sub 21 having a top portion, a bottom portion and a central bore by passing the elongated pin 22 through the central bore until the bottom portion of the sub 21 rests upon the base portion 23 of the tang 19. The base portion 23 of the tang 19 may be placed into one of the tang receiving fixtures 24 on the bottom portion 2 of the sub basket 1. The elongated pin portion 22 of the tang 19 may engage a tang aperture 20 on the support member 8 when the support member 8 is in a closed position.

In another exemplary embodiment, a method of storing and transporting subs is provided including, installing the sub 21 on a tang 19 having a base portion 23, an elongated pin 22 extending upwards from the base portion 23, and a cap 9, placing the tang 19 vertically in a sub basket 1 having tang receiving fixtures 24 spaced on a bottom portion 2 therein, engaging support members 8 connected to top portions of the sub basket 1 such that the support members 8 receive top portions of the elongated pins 22, latching the support members 8 in a closed position with a handle latch 13, further locking the support members 8 in a closed position by use of a door 7 that prevents rotation of the support members 8 when the door 7 is closed, and locking the door 7 closed by latching the door 7 to an end portion of the sub basket 1.

In the foregoing example embodiments are described. It will, however, be evident that various modifications and changes may be made thereunto without departing from the broader spirit and scope hereof. The specification and drawings are accordingly to be regarded in an illustrative rather than in a restrictive sense.

What is claimed is:

1. An apparatus for storing and transporting subs, comprising:

a frame including a bottom portion; and, a front side, a back side, a first end, and a second end, the front and back sides and the first and second ends each being fixed to the bottom portion; and, an interior portion formed by the bottom portion and the front and back sides and the first and second ends and an open top section;

a plurality of tangs having a base portion, an elongated pin extending upwards from the base portion, and a cap;

a plurality of support members fixed generally orthogonally to a top portion of the first and second ends such that the support members are positionable between an open position and a closed position;

handle latches fixed to the top portion of the first and second ends such that each latch correspondingly engages and locks each of the support members being in the open position or the closed position;

a first door hinged to the first end, the first door adjustable such that the first door further secures the support members in a fixed position when the first door is placed in a first closed position and permits repositioning of the support members when the first door is placed in a first open position;

a second door hinged to the second end, the second door adjustable such that the second door further secures the support members in a fixed position when the second door is placed in a second closed position and permits repositioning of the support members when the second door is placed in a second open position;

a first pin latch and a second pin latch fixed to the first door and the second door, respectively, so that the first and second pin latches lock each of the first and second doors in the first and second closed positions when the first and second pin latches are engaged;

wherein each of the tangs receives a sub, the sub having a top portion, a bottom portion and a central bore extending from the bottom portion of the sub to the top portion of the sub;

wherein the sub is installed on each of the tangs by passing the elongated pin of each of the tangs through the central bore of the sub, allowing the bottom portion of the sub to rest upon a receiving surface on the base portion of each of the tangs and placing the cap upon the top portion of the sub;

wherein the elongated pin of each of the tangs extends beyond the cap;

wherein the tangs are arranged substantially vertically on the bottom portion of the frame such that each of the support members engages top portions of the tangs when each of the support members is in the closed position.

2. The apparatus of claim 1, further comprising: a compression spring connected to the handle latches such that the handle latches are held in a locked position until a load is applied against the compression spring to disengage the handle latches from the support members.

3. The apparatus of claim 1, further comprising: an eyelet on a top corner of the frame facing a center of the apparatus.

4. The apparatus of claim 1, further comprising: a plurality of tang receiving fixtures on the bottom portion of the frame within the interior portion of the frame such that the base portions of the tangs are configured to be placed within the tang receiving fixtures.

5. The apparatus of claim 1, further comprising: a sub receiving surface attached to the base portion of the tang.

6. The apparatus of claim 5, wherein the sub receiving surface is a replaceable rubber surface.

7. The apparatus of claim 1, wherein the elongated pin of the tang is threaded.

8. The apparatus of claim 7, wherein the cap includes a threaded opening in a center of the cap such that the cap is configured to be threaded on the elongated pin of the tang.

9. The apparatus of claim 1, further comprising: a compression spring connected to the first pin latch such that the first pin latch is held in a locked position until a load is applied.

10. The apparatus of claim 9, wherein the first pin latch engages a latch aperture on first end of the frame.

11. The apparatus of claim 10, further comprising: a second latch such that the pin of the first pin latch is first released from the second latch before the pin of the first pin latch may be disengaged from the latch aperture on the frame end.

12. The apparatus of claim 1, wherein the support members include an elongated support portion and circular disc ends such that the elongated support portion is fixed to an outer circumference of the circular disc ends.

13. The apparatus of claim 12, further comprising: disc pins attached to the circular disc ends on an opposite side from the elongated support portion such that the disc pins extend through arched openings in the first and second ends of the frame.

14. The apparatus of claim 13, wherein the disc pins are moveable along the arched opening causing the support members to move between the closed position and the open position.

15. The apparatus of claim 12, wherein the elongated support portion of the support members includes tang apertures such that the tang apertures receive the top portions of the tangs when the support members are closed.

* * * * *